US008746602B2

(12) United States Patent
Bodurov et al.

(10) Patent No.: US 8,746,602 B2
(45) Date of Patent: Jun. 10, 2014

(54) GRINDING MEDIA

(75) Inventors: Petar Bodurov, Sofia (BG); Todor Penchev, Sofia (BG)

(73) Assignee: Assarel-Medet AD, Panagurishte (BG)

( * ) Notice: Subject to any disclaimer, the term of this patent is extended or adjusted under 35 U.S.C. 154(b) by 363 days.

(21) Appl. No.: 13/138,462

(22) PCT Filed: Dec. 17, 2009

(86) PCT No.: PCT/BG2009/000021
§ 371 (c)(1),
(2), (4) Date: Aug. 19, 2011

(87) PCT Pub. No.: WO2010/094091
PCT Pub. Date: Aug. 26, 2010

(65) Prior Publication Data

US 2011/0297775 A1 Dec. 8, 2011

(30) Foreign Application Priority Data

Feb. 19, 2009 (BG) ..... 110329

(51) Int. Cl.
*B02C 17/14* (2006.01)

(52) U.S. Cl.
USPC ..... 241/184

(58) Field of Classification Search
USPC ..... 241/184; 451/330
See application file for complete search history.

(56) References Cited

U.S. PATENT DOCUMENTS

| | | | | | |
|---|---|---|---|---|---|
| 90,824 | A | * | 6/1869 | Dickinson | 451/41 |
| 591,225 | A | * | 10/1897 | Bartlett | 451/330 |
| 1,133,368 | A | * | 3/1915 | Vilbiss | 451/330 |
| 1,218,158 | A | * | 3/1917 | Anderws | 451/330 |
| 1,331,964 | A | * | 2/1920 | Newhouse | 241/184 |
| 1,388,462 | A | * | 8/1921 | Hardinge | 241/184 |
| 1,431,475 | A | | 10/1922 | MacDonald | |
| 1,464,700 | A | * | 8/1923 | Feust | 241/184 |
| 1,720,024 | A | * | 7/1929 | Young | 241/184 |
| 1,860,393 | A | * | 5/1932 | Newhouse | 241/184 |
| 2,069,731 | A | * | 2/1937 | Trumpler | 264/5 |
| 2,431,870 | A | * | 12/1947 | Huenerfauth et al. | 451/330 |
| 2,440,656 | A | * | 4/1948 | Huntington | 51/303 |
| 2,847,169 | A | * | 8/1958 | Hartman | 241/184 |

(Continued)

FOREIGN PATENT DOCUMENTS

| | | |
|---|---|---|
| DE | 440198 | 1/1927 |
| FR | 811408 | 4/1937 |

(Continued)

*Primary Examiner* — Faye Francis

(74) *Attorney, Agent, or Firm* — D. Peter Hochberg; Sean F. Mellino; Richard A. Wolf

(57) ABSTRACT

Grinding media for fragmentation and grinding of ores, rock and earth mass and other materials mostly in drum mills, for application in ore mining, construction and other industrial branches. The grinding media have the form of spheroidal tetrahedron, obtained from the crossing of four spheres with equal radii, the centers of each one lie on the top of the surface of the others and are tips of regular tetrahedron. The radii of the spheres are equal to the regular tetrahedron's edge. At least one of the tips (1) of the spheroidal tetrahedron is flatly beveled and the rest are rounded, so one and the same mass of material is taken away from each tip (1). It is possible the edges (2) of the grinding media to be rounded, beveled or ribbed. The ribbing can be even or arch-shaped.

5 Claims, 3 Drawing Sheets

(56) References Cited

U.S. PATENT DOCUMENTS

| | | | | | |
|---|---|---|---|---|---|
| 2,947,124 | A | * | 8/1960 | Madigan et al. | 451/35 |
| 2,978,850 | A | * | 4/1961 | Gleszer | 451/35 |
| 3,613,317 | A | * | 10/1971 | Kittredge | 451/330 |
| 4,634,062 | A | * | 1/1987 | Berchem | 241/184 |
| 4,712,333 | A | * | 12/1987 | Lofton | 451/330 |
| 2008/0223962 | A1 | * | 9/2008 | Kemppainen et al. | 241/2 |

FOREIGN PATENT DOCUMENTS

| | | |
|---|---|---|
| RU | 1388088 | 4/1988 |
| RU | 2305597 | 9/2007 |
| SU | 1388088 | 4/1988 |

* cited by examiner

GRINDING MEDIA

CROSS-REFERENCE TO RELATED APPLICATIONS

This application is a National Stage application of International Application No. PCT/BG2009/000021, filed on Dec. 17, 2009, which claims priority of Bulgarian Application Serial Number 110329 filed on Feb. 19, 2009, both of which are incorporated herein by reference in their entireties.

BACKGROUND OF THE INVENTION

1. Field of the Invention

The invention relates to a grinding media for the fragmentation and grinding of ores, rock and earth mass and other inert materials in drum and other types of mills, and it finds application in ore mining, construction and other industrial branches.

2. Description of the Prior Art

Widely known and used in practice is grinding media for drum mills with a spheroidal form. A disadvantage of the spheroidal grinding media is the low productivity of the mills, operating with such media, because their form does not allow good compaction of the working space, and the lack of edges extends the time for breaking of the grinded material and reduces the effectiveness.

From the prior art, a grinding media in the form of a tetrahedron with smooth or slightly rounded walls at their ends and rounded edges and tips [DE 440198/1927] is also known. This grinding media is more effective from the spheroidal one because it allows for a better compaction of the working space. A drawback of this grinding media is that its form is difficult to be manufactured by stamping, rolling or founding—the main methods for the manufacturing of mass articles of this kind. This leads to a big increase of manufacturing costs of grinding media and reduces the effectiveness from their usage. Another drawback of this grinding media proceeds from its geometric form—flat surrounding walls—its rolling in the mill during the working process is difficult, and the contact surface between the grinding media and the mill's walls is rather small.

From the prior art, a grinding media with the form of "Reuleaux triangle" with rounded edges and tips, obtained from the crossing of four spheres, the centers of each one lie on the top of the surface of the others and appearing as tips of regular tetrahedron and the radii of the spheres are equal to the regular tetrahedron's edge [RU1 388088/1985] is also known. This grinding media is more effective than those with spheroidal or pyramidal form, as it allows better compaction of the working space and at the same time provides a bigger contact area between the grinding media and the mill's wall at equal mass. An essential drawback of this grinding media is that its manufacturing is a complicated and labour-consuming process, which makes the grinding media much more expensive and reduces the profitability from its use in the grinding process.

A cubic shape grinding body with flat sides and whose edges and tips are roundly beveled is also known—[US 1 431 475/1922]. That grinding body was also highly non-technological to produce because of which it had not found wide application.

A spheroidal tetrahedron shape grinding body is also known, of which only three edges coming of the same tip are rounded and the remaining edges and tips are not rounded [RU 2 305 597/2007]. The surfaces of those three rounded edges are formed by the rotation of the arcs of the edges around the chords, connecting two tips. Those three edges of the tetrahedron have a cross-section similar to a circle and their cross-sections are variable along their lengths. That suggested body is known in geometry as Meissner Tetrahedron. That grinding body is exceptionally difficult and expensive to produce, and the additionally rounded edges with the described shape and variable cross-section would prevent the sliding of the bodies at each other, which in turn would make the grinding of ore materials impossible.

In another patent [FR 811 408/1937] a grinding body of shape similar to the above mentioned patent [DE 440 198/1927] is discussed. A general characteristic of the described body of tetrahedron shape with flat or slightly rounded faces, as well as of spheroidal tetrahedron shape, whose faces are part of a sphere, is its extremely difficult and expensive, even practically impossible mass production, which is a requirement for the grinding bodies.

Cubes, even with round beveled tips and edges, are equally inapplicable for mass production.

SUMMARY OF THE PRESENT INVENTION

The objective of the invention is to create a grinding media with a form comfortable for manufacturing which enables the grinding media to quickly and effectively crush and grind the fed material.

The objective is achieved through the invention of grinding media with the form of spheroidal tetrahedron, obtained from the crossing of four spheres with equal radii, the centers of each one lie on the surface of the others and are tips of a regular tetrahedron, and the radii of the spheres are equal to the edge of the regular tetrahedron, where at least one of the tips of the spheroidal tetrahedron is flat while the rest are adjusted by taking away material, so that one and the same mass of material is taken away from each tip.

It is possible for the edges of the grinding media to be sharp, rounded, beveled or ribbed. The ribbing can be even or arch-shaped. Depending on the hardness of the material and the size of the pieces, grinding media with sharp, rounded, beveled or ribbed edges are selected.

The main advantage of the grinding media according to the invention is the possibility to be manufactured by using the traditional methods for manufacturing of this kind of mass articles. The availability of a flatly beveled tip allows for manufacturing through stamping which is the most appropriate method for manufacturing of metal grinding media. This reduces the prime cost of the grinding media and increases the profitability of the mill. The presence of sharp edges accelerates the breaking of the grinded material and increases the effectiveness of the mills using such grinding media.

In addition, the invented grinding media wears out evenly because its center of gravity coincides with the geometric center of the body, and the likelihood of damages, leading to an accelerated wearing out process, as a result from collisions and bumps during work, is reduced, since the tips are rounded or flatly beveled. The geometry of the body allows a good compaction between the grinding media and the mill's walls during the work process and ensures a relatively large contact surface between them.

BRIEF DESCRIPTION OF THE DRAWINGS

The invention is illustrated in details with exemplary embodiments of grinding media, which are shown with the figures included, where.

DETAILED DESCRIPTION OF THE PRESENT INVENTION

Description of Preferred Embodiments

Figure 1:
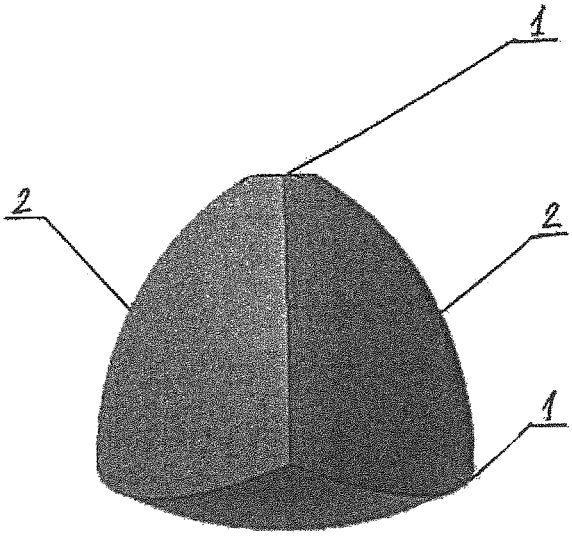
FIG. 1 represents a front view of grinding media with one flatly beveled tip.
Figure 2:
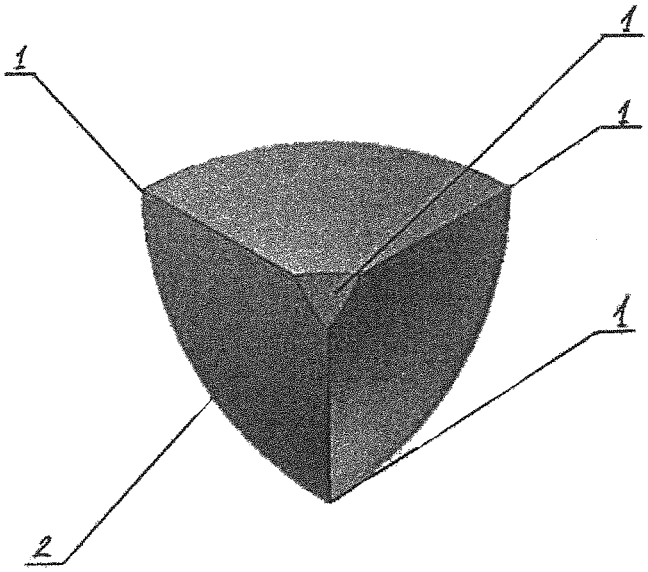
FIG. 2—a view from above of grinding media with one flatly beveled tip.

FIGS. 1 and 2 show an embodiment of a grinding media according to the invention, with the form of a spheroidal tetrahedron, obtained from the crossing of four spheres with equal radii, in which the centers of each one lie on the surface of the others and are the tips of a regular tetrahedron. The radii of the spheres are equal to the edge of the regular tetrahedron. One of the tips 1 of the spheroidal tetrahedron is flat, and the other tips 1 are adjusted by taking away material, so one and the same mass of material is taken away from each tip 1.

Figure 3:
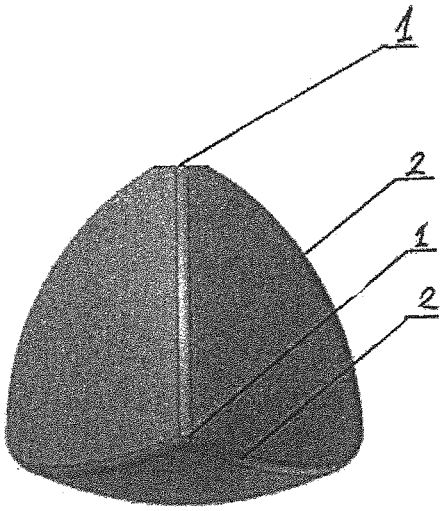
FIG. 3—a front view of grinding media with one flatly beveled tip and rounded edges.
Figure 4:
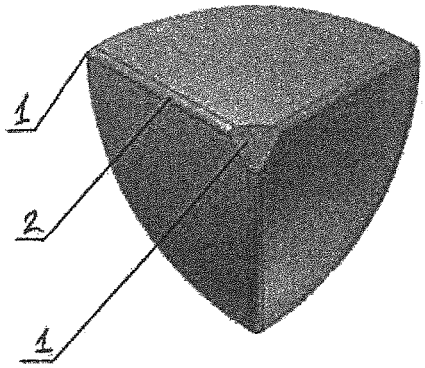
FIG. 4—a view from above of grinding media with one flatly beveled tip and rounded edges.

FIGS. 3 and 4 show a preferred embodiment of grinding media according to the invention with one flatly beveled tip 1 and rounded edges 2.

Figure 5:
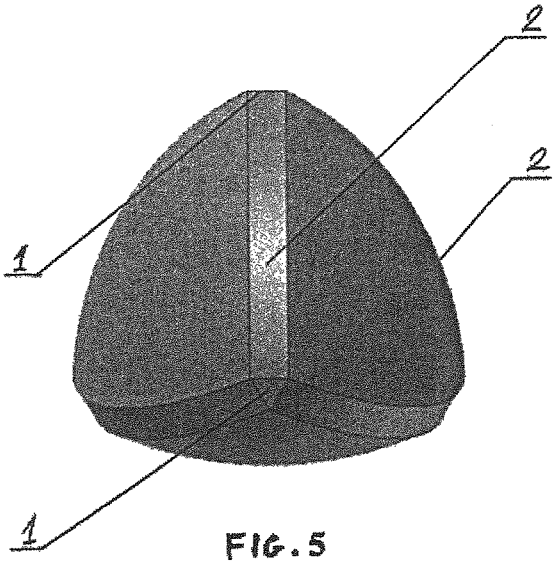
FIG. 5—a front view of grinding media with a flatly beveled tips and flatly beveled edges.

FIG. 5 shows a preferred embodiment of grinding media according to the invention, where all the tips 1 and edges 2 are flatly beveled.

Figure 6:
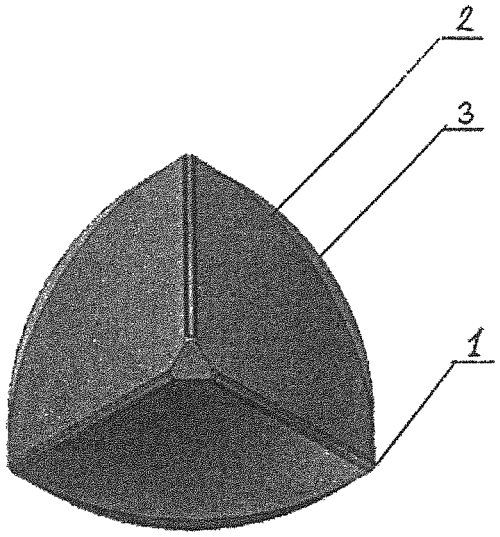
FIG. 6—a view from above of grinding media with a flatly beveled tip and arch-shaped ribbed edges.

FIG. 6 shows a preferred embodiment of grinding media according to the invention with one flat tip 1 and arch-shaped ribbed edges 2.

OPERATION OF THE INVENTION

The grinding media according to the invention are used in drum mills and other types of mills for the grinding of ores, rock and other materials. The grinding media are placed in the mill beforehand. The rotation of the drum creates a centrifugal force, which pushes off the grinded material and the grinding media to the walls of the mill's drum, carries them away in the direction of the rotation, so under the impact of their own weight the grinding media and the grinded material firstly slide and tumble over the drum's wall and when reaching a given height they detach from the wall and fall down.

During the fall they bump into each other, into chunks of grinded material or into the drum's wall. When colliding with a material, the kinetic energy accumulated by the grinding media breaks and crushes the material into smaller pieces. If the chunks of the grinded material have higher hardness and/or larger size, the process of breaking is faster when the grinding media have sharp edges. If the edges are ribbed, the grinding media wear out more slowly. The constant crashes of grinding media with sharp edges 2 lead to a faster wearing out process of the grinding media, so when the grinded material is finer, the use of grinding media with rounded edges 2 is more profitable. After reaching the lower part of the drum, the grinding media are pressed by the centrifugal forces to the wall again or to other grinding media and mill the grinded material among them. The larger contact surface of the grinding media during the collision with the wall or with the other grinding media at equal other conditions increases the effectiveness of the grinding process. If the center of gravity of the grinding media coincides with their geometric center, they wear out evenly and their life becomes longer.

A large number of grinding media are used in the mills, but they wear out comparatively fast and have to be often replaced—normally at every 30-40 days. Over 30 million tons of grinding media are used globally per year. Facilitating the manufacturing of the grinding media with the same and/or improved quality parameters leads to reduced prime costs of the grinding media, respectively to increased profitability of the mills using such grinding media.

What has been described above are preferred aspects of the present invention. It is of course not possible to describe every conceivable combination of components or methodologies for purposes of describing the present invention, but one of ordinary skill in the art will recognize that many further combinations and permutations of the present invention are possible. Accordingly, the present invention is intended to embrace all such alterations, combinations, modifications, and variations that fall within the spirit and scope of the appended claims.

We claim:

1. Grinding media having the form of a spheroidal tetrahedron, obtained from the crossing of four spheres with equal radii, wherein the respective center of each sphere lies on a surface of the other spheres and are tips of a regular tetrahedron, and wherein the radii of the spheres are equal to the edge of the regular tetrahedron, wherein at least one of the tips of the spheroidal tetrahedron is flatly beveled, and the other of said at least one tip is adjusted by taking away material so that one and the same mass of material is taken away from each tip.

2. The grinding media according to claim 1, wherein the edges and the rest of the adjusted tips are rounded.

3. The grinding media according to claim 1, wherein the tips and the edges are flatly beveled.

4. The grinding media according to claim 1, wherein the edges of the grinding media are ribbed.

5. The grinding media according to claim 4, wherein the ribbing of the edges is arch-shaped and the ends of the arch coincide with the tips of the respective rib.

* * * * *